US007523971B2

(12) United States Patent
Ebert

(10) Patent No.: US 7,523,971 B2
(45) Date of Patent: Apr. 28, 2009

(54) SPINDLE ASSEMBLY WITH CAPTIVE SPRING FOR USE IN A DOOR HANDLE ASSEMBLY

(75) Inventor: David Allan Ebert, Schwenksville, PA (US)

(73) Assignee: Newfrey, LLC, Newark, DE (US)

( * ) Notice: Subject to any disclaimer, the term of this patent is extended or adjusted under 35 U.S.C. 154(b) by 322 days.

(21) Appl. No.: 11/149,745

(22) Filed: Jun. 10, 2005

(65) Prior Publication Data

US 2006/0284429 A1 Dec. 21, 2006

(51) Int. Cl.
*E05B 3/00* (2006.01)
*E05B 1/00* (2006.01)

(52) U.S. Cl. ..... 292/358; 292/347; 292/359; 70/224

(58) Field of Classification Search ..... 292/358, 292/165, 347, 359, 348, 350; 70/224
See application file for complete search history.

(56) References Cited

U.S. PATENT DOCUMENTS

| | | | | | |
|---|---|---|---|---|---|
| 84 | A | * | 11/1836 | Liringston et al. | 60/670 |
| 294,881 | A | * | 3/1884 | Jones | 292/348 |
| 467,039 | A | * | 1/1892 | Mathesen | 292/358 |
| 671,943 | A | * | 4/1901 | Smith | 292/353 |
| 734,117 | A | * | 7/1903 | Caley | 292/358 |
| 939,191 | A | * | 11/1909 | Fletcher | 292/358 |
| 1,015,765 | A | * | 1/1912 | Spring | 292/358 |
| 1,451,829 | A | * | 4/1923 | Hubbard | 292/358 |
| 1,472,481 | A | * | 10/1923 | Lockwood | 292/358 |
| 1,584,153 | A | * | 5/1926 | Sullivan | 292/356 |
| 1,634,845 | A | * | 7/1927 | Netschert | 292/359 |
| 1,970,758 | A | * | 8/1934 | Lyons et al. | 292/358 |
| 2,702,204 | A | * | 2/1955 | Collier | 292/169.14 |
| 3,257,138 | A | * | 6/1966 | Russell et al. | 292/336.3 |
| 4,099,759 | A | * | 7/1978 | Kornhauser | 293/110 |
| 4,471,984 | A | * | 9/1984 | Bellantuono | 292/350 |
| 4,502,720 | A | * | 3/1985 | Fayerman et al. | 292/348 |
| 4,667,994 | A | * | 5/1987 | Foshee | 292/358 |
| 4,728,133 | A | * | 3/1988 | Valley | 292/336.3 |
| 4,746,155 | A | * | 5/1988 | Hart | 292/351 |
| 5,088,778 | A | * | 2/1992 | Lin | 292/336.3 |
| 5,140,203 | A | * | 8/1992 | Reder et al. | 310/29 |
| 5,219,192 | A | * | 6/1993 | Berger | 292/173 |
| 5,505,508 | A | * | 4/1996 | Kuo | 292/359 |
| 5,624,141 | A | * | 4/1997 | Kuo et al. | 292/165 |

(Continued)

*Primary Examiner*—Carlos Lugo
(74) *Attorney, Agent, or Firm*—Richard J. Veltman, Esq.; Taylor & Aust, P.C.; Ronald K. Aust, Esq.

(57) ABSTRACT

A door handle assembly includes a spindle assembly having a first spindle and a second spindle. The first spindle has a shaft portion located between a first head portion and a first coupling end. The shaft portion has a first hub drive portion configured to engage a first hub portion of a split hub when inserted into the split hub in a first direction. The second spindle has a second head portion, a second hub drive portion and a second coupling end. The second coupling end is configured to slidably engage the first coupling end of the first spindle. The second hub drive portion is configured to engage a second hub portion of the split hub when inserted into the split hub in the first direction. A retainer device is attached to the shaft portion of the first spindle. A spring is captively positioned between the first head portion of the first spindle and the retainer device.

24 Claims, 6 Drawing Sheets

U.S. PATENT DOCUMENTS 5,685,584 A * 11/1997 Baren et al. ..... 292/358
5,813,708 A * 9/1998 Shen ..... 292/165
5,941,108 A * 8/1999 Shen ..... 70/467

* cited by examiner

SPINDLE ASSEMBLY WITH CAPTIVE SPRING FOR USE IN A DOOR HANDLE ASSEMBLY

BACKGROUND OF THE INVENTION

1. Field of the Invention

The present invention relates to a door handle assembly, and, more particularly, to a spindle assembly with a captive spring for use in a door handle assembly.

2. Description of the Related Art

Door handle assemblies have long been available that include a door handle, e.g., knob or lever, for operating a door latch mechanism. The door handle includes, for example, an operator portion and a shank. Included in the door handle assembly is a coupling, which may include two or more loose parts, that connects the door handle shank to the door latch mechanism.

Split-hub latches are used, wherein each hub portion of the split hub rotates independently of the other hub portion to operate the latch bolt of the door latch mechanism. In some designs, two separate spindles are used to independently operate each of the two hub portions, with each spindle being driven by a separate operator, e.g., door handle or lever. Such an arrangement, however, may be difficult to assemble due to the multiple loose parts.

SUMMARY OF THE INVENTION

The invention, in one exemplary embodiment, is directed to a door handle assembly, including a latch mechanism and a spindle assembly. The latch mechanism has a split hub. The split hub has a first hub portion and a second hub portion. Each of the first hub portion and the second hub portion is configured to independently operate the latch mechanism. The spindle assembly includes a first spindle and a second spindle. The first spindle has a shaft portion located between a first head portion and a first coupling end. The shaft portion has a first hub drive portion configured to engage the first hub portion when inserted into the split hub in a first direction. The second spindle has a second head portion, a second hub drive portion and a second coupling end. The second coupling end is configured to slidably engage the first coupling end of the first spindle to provide independent rotational engagement of the first spindle with the second spindle. The second hub drive portion is configured to engage the second hub portion when inserted into the split hub in the first direction. A retainer device is attached to the shaft portion of the first spindle. A spring is positioned captive between the first head portion of the first spindle and the retainer device attached to the shaft portion of the first spindle.

The invention, in another exemplary embodiment, is directed to a spindle assembly. The spindle assembly includes a first spindle, a second spindle, a retainer device and a spring. The first spindle has a shaft portion located between a first head portion and a first coupling end. The shaft portion has a first hub drive portion. A second spindle has a second head portion, a second hub drive portion and a second coupling end. The second coupling end is configured to slidably engage the first coupling end to provide independent rotational engagement of the first spindle with the second spindle. The retainer device is attached to the shaft portion of the first spindle. The spring is positioned captive between the first head portion of the first spindle and the retainer device attached to the shaft portion of the first spindle.

The invention, in another exemplary embodiment, is directed to a method of forming a spindle assembly for use with a latch mechanism. The method includes providing a first spindle having a shaft portion located between a first head portion and a first coupling end, the shaft portion having a hub drive portion; and positioning a spring captive between the first head portion of the first spindle and a retainer device attached to the shaft portion of the first spindle.

The invention, in another exemplary embodiment, is directed to a method of assembling a door handle assembly, the door handle assembly including a latch mechanism having a split hub, the split hub having a first hub portion and a second hub portion, each of the first hub portion and the second hub portion being configured to independently operate the latch mechanism; a first door handle having a first operator portion, and a first shank extending from the first operator portion, the first shank having a first cavity; and a second door handle having a second operator portion, and a second shank extending from the second operator portion, the second shank having a second cavity. The method includes providing a spindle assembly including a first spindle, a second spindle, a retainer device, and a spring positioned captive between a first head portion of the first spindle and the retainer device attached to a shaft portion of the first spindle; sliding a second head portion of the second spindle of the spindle assembly through the split hub; inserting the first head portion of the first spindle in the first cavity of the first shank of the first door handle; engaging the spring of the spindle assembly with the first shank of the first door handle to position a first hub drive portion of the first spindle relative to the first hub portion and to position a second hub drive portion of the second spindle relative to the second hub portion.

In one embodiment, for example, an advantage of the invention is the reduction in the number of loose parts needed to assemble the door handle assembly, thereby making assembly easier.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
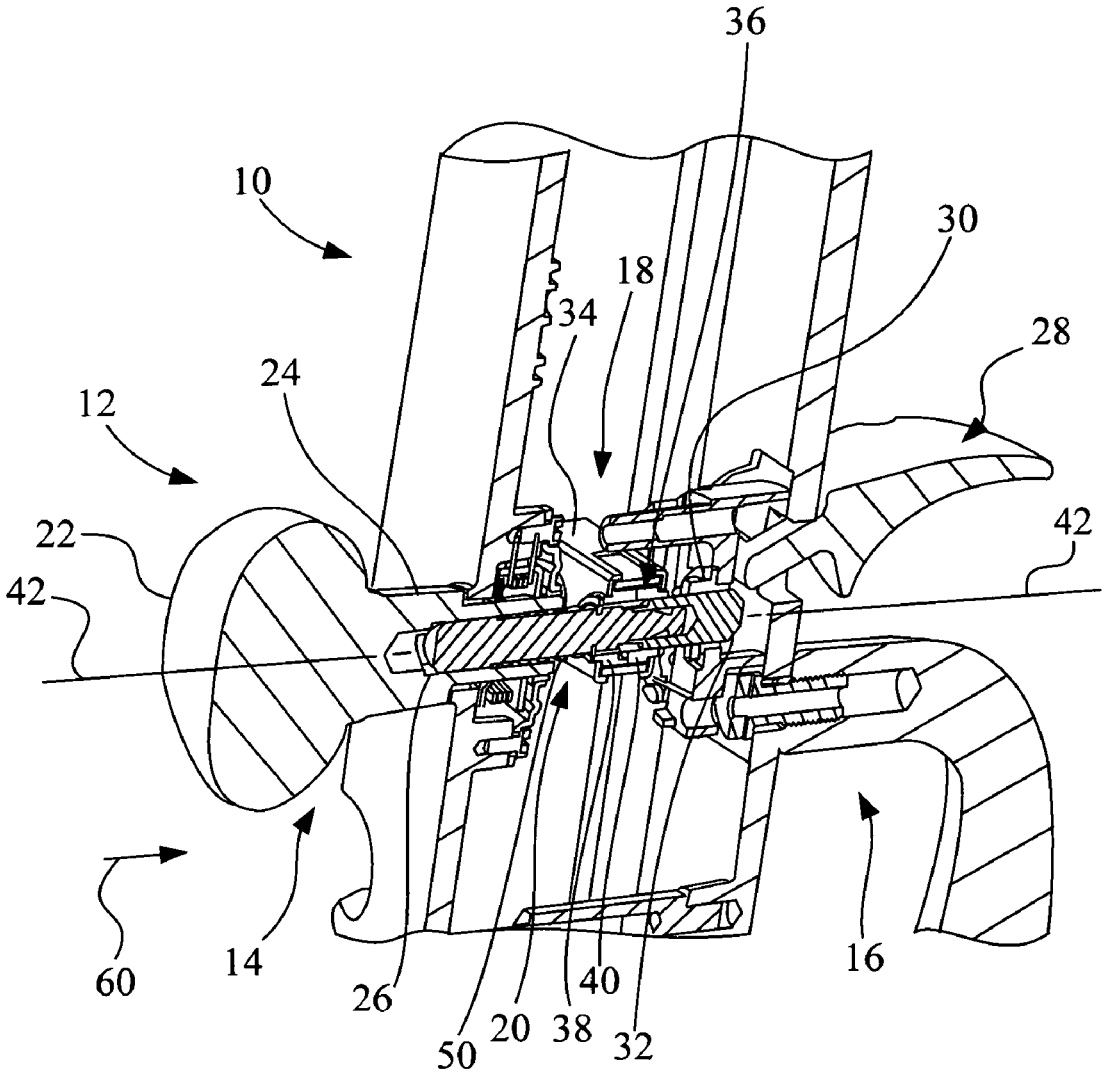
FIG. 1 is a sectioned perspective view of a door handle set embodying the present invention.

Referring now to the drawings, and more particularly to FIG. 1, there is shown a door 10 having mounted thereto a door handle assembly 12. Door handle assembly 12 includes a door handle 14, a door handle 16, a latch mechanism 18, and a spindle assembly 20 in accordance with the present invention. The invention is designed to adjust to a limited range of door thickness and manufacturing tolerances of the door handle assemblies and installations, while keeping spindle assembly 20 properly aligned in latch mechanism 18.

Door handle 14 has an operator portion 22 and a shank 24 extending from first operator portion 22. Door handle 14 may be, for example, an interior door handle. In the embodiment of FIG. 1, operator portion 22 is a door knob. Shank 24 has a cavity 26. Cavity 26 has a shape and depth selected to accommodate a corresponding portion of spindle assembly 20.

Door handle 16 has an operator portion 28, and a shank 30 extending from operator portion 28. Shank 30 has a cavity 32. Cavity 32 has a shape and depth selected to accommodate a corresponding portion of spindle assembly 20.

Latch mechanism 18 includes a body 34 supporting a latch bolt (not shown) operated by a split hub 36. Split hub 36 has a first hub portion 38 and a second hub portion 40. Each of first hub portion 38 and second hub portion 40 are configured to independently operate latch mechanism 18 by their respective individual rotation about a rotational axis 42.

Figure 2:
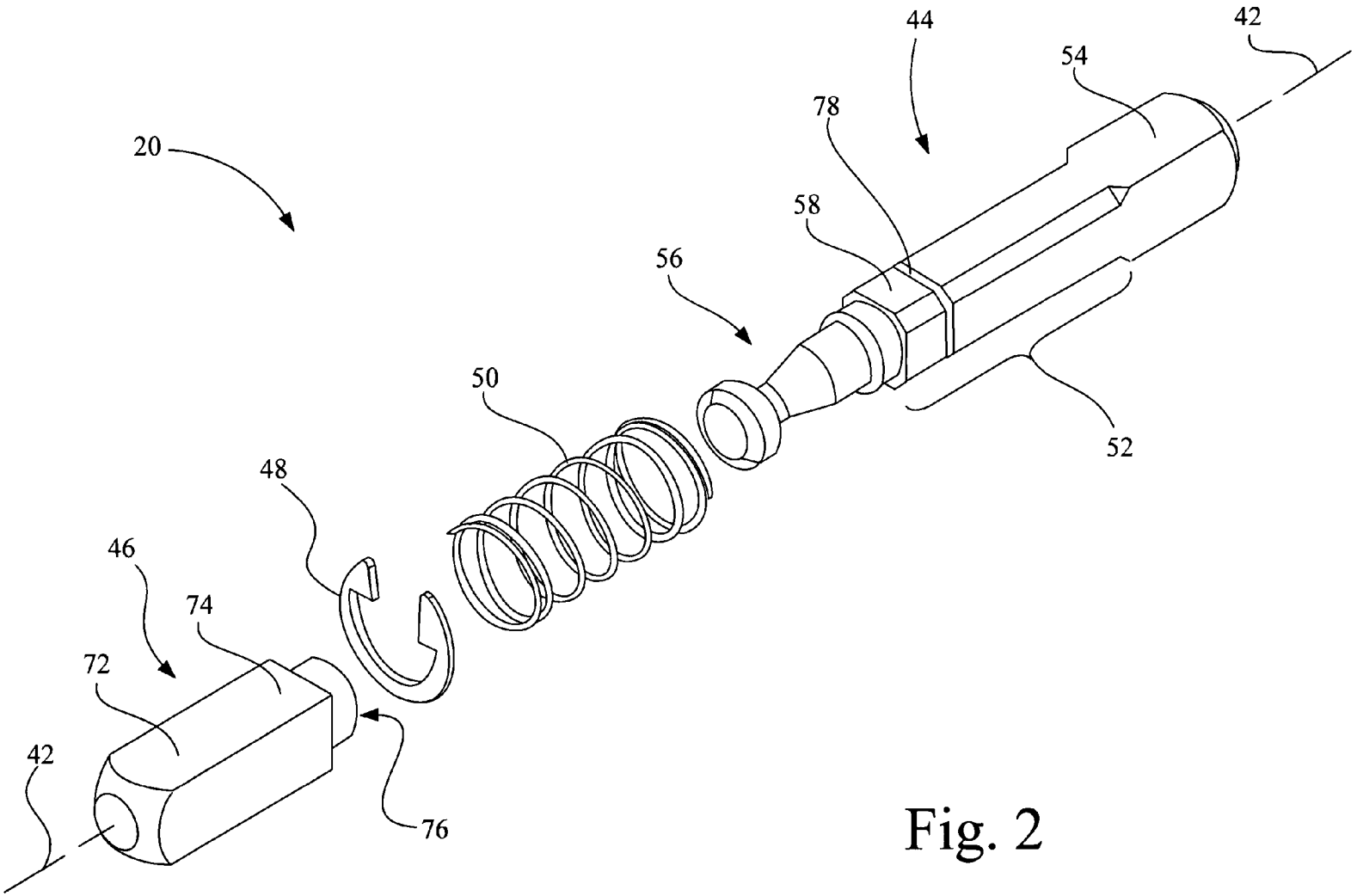
FIG. 2 is an exploded perspective view of a spindle assembly in accordance with the present invention.
Figure 3:
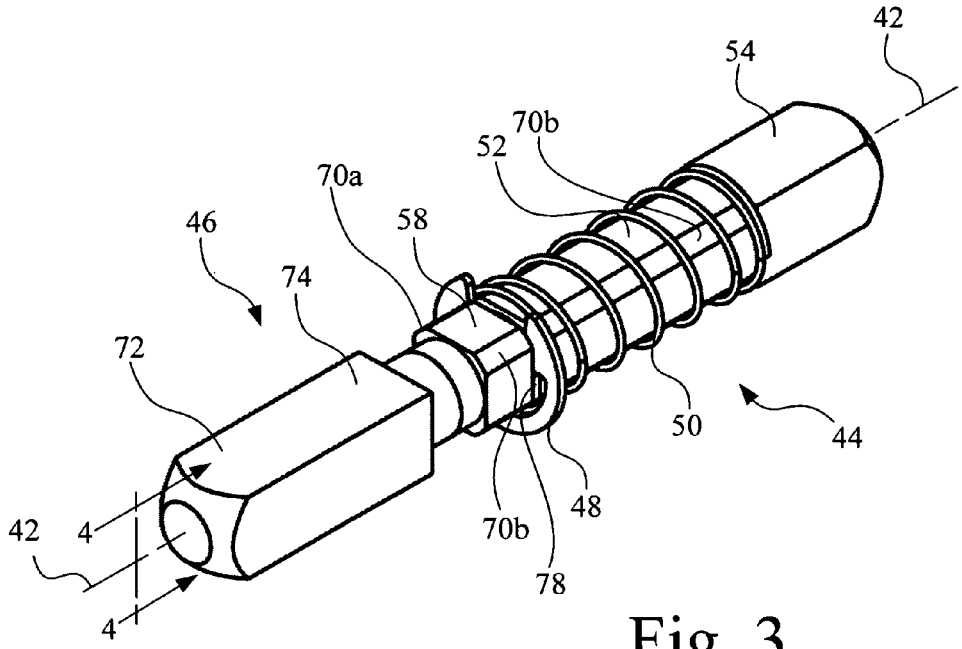
FIG. 3 is a perspective view of the spindle assembly of FIG. 2 in an assembled state.
Figure 4:
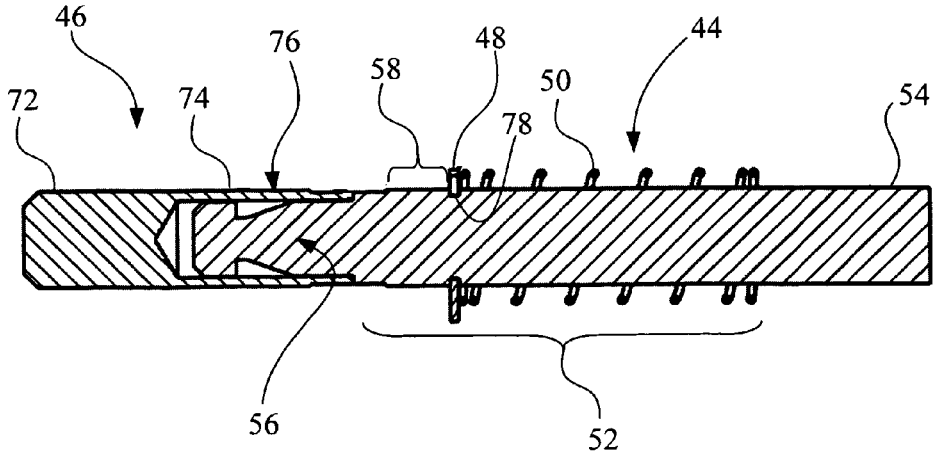
FIG. 4 is a section view of the spindle assembly of FIG. 3 taken along line 4-4.

As shown in FIGS. 2, 3 and 4, spindle assembly 20 includes a first spindle 44, a second spindle 46, a retainer device 48 and a spring 50.

First spindle 44 has a shaft portion 52 located between a head portion 54 and a coupling end 56. Shaft portion 52 has a first hub drive portion 58. First hub drive portion 58 is configured to engage first hub portion 38 of split hub 36 when inserted into split hub 36 in a direction 60 along rotational axis 42 (see also FIG. 1).

Head portion 54 of first spindle 44 has a size and shape corresponding to that of cavity 26 of shank 24 of door handle 14. Cavity 26 of door handle 14 is configured to slidably receive and drive head portion 54 of first spindle 44, so as to facilitate the common rotation of shank 24 and first spindle 44, and in turn first hub portion 38 of split hub 36, about the rotational axis 42 to operate latch mechanism 18 independently from the operation of latch mechanism 18 by door handle 16.

Figure 5A:
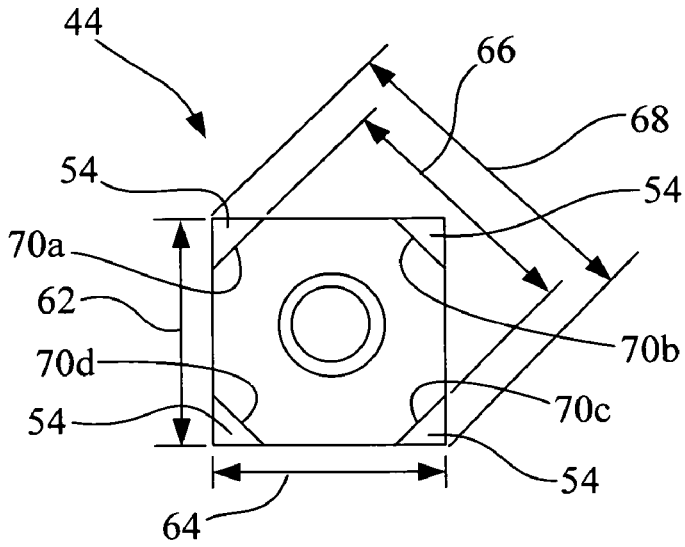
FIG. 5A is an end view of one spindle of the spindle assembly of FIG. 2 showing the relative dimensions thereof.
Figure 5B:
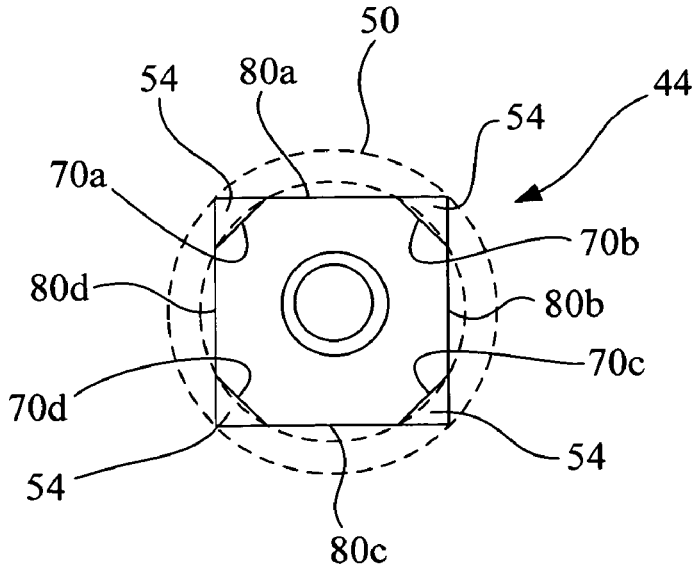
FIG. 5B is an end view of the spindle of FIG. 5A showing the location of the spring in relation to the head portion of the spindle.

Referring to FIGS. 5A and 5B, shaft portion 52 and head portion 54 of first spindle 44 have common orthogonal dimensions 62 and 64, e.g., height and width, in cross-section, and have at least one different diagonal dimension in cross-section. For example, the diagonal dimension 66 of shaft portion 52 is smaller than the corresponding diagonal dimension 68 of head portion 54. The common orthogonal dimensions 62 and 64 define a generally rectangular structure, such as a generally square structure, in cross-section. In the embodiment shown, shaft portion 52 has reduced cross-section, e.g., beveled, corners 70*a*, 70*b*, 70*c* and 70*d*, thereby defining head portion 54 of first spindle 44 where reduced cross-section, e.g., beveled, corners 70*a*, 70*b*, 70*c* and 70*d* end. As shown in FIG. 5A, diametrically opposed beveled corners 70*a* and 70*c* are located at the diagonal dimension 66 of the rectangular structure. Beveled corners 70*b* and 70*d* are located diametrically opposed along another diagonal dimension.

Those skilled in the art will recognize that the reduced cross-section corners 70*a*, 70*b*, 70*c* and 70*d* may have shapes other than beveled in cross-section. For example, in addition to being beveled, reduced cross-section corners 70*a*, 70*b*, 70*c* and/or 70*d* may be rounded, or form a smaller square in cross-section than head portion 54.

Referring again to FIGS. 2-4, second spindle 46 has a head portion 72, a second hub drive portion 74, and a coupling end 76. Coupling end 76 is configured to slidably engage coupling end 56 of first spindle 44 to provide independent rotational engagement of first spindle 44 with second spindle 46. For example, coupling end 76 of second spindle 46 may be configured as a cylindrical bore, and coupling end 56 of first spindle 44 may be configured as a cylindrical piston. Second hub drive portion 74 is configured to engage second hub portion 40 of split hub 36 when inserted into split hub 36 in direction 60.

Head portion 72 of second spindle 46 has a size and shape corresponding to that of cavity 32 of shank 30 of door handle 16. Cavity 32 of door handle 16 is configured to slidably receive and drive second head portion 72 of second spindle 46, so as to facilitate the common rotation of shank 30 and second spindle 46, and in turn second hub portion 40 of split hub 36, about the rotational axis 42 to operate latch mechanism 18 independently from the operation of latch mechanism 18 by door handle 14.

Retainer device 48 is attached to shaft portion 52 of the first spindle 44. Shaft portion 52 may include, for example, a peripheral groove 78. As such, retainer device 48 may be in the form of a C-clip that engages peripheral groove 78.

Spring 50 may be, for example, a coil spring having a diameter sized to slide over shaft portion 52 of first spindle 44, but sized to not slide over head portion 54 of first spindle 44, as illustrated in FIGS. 3 and 5B. Thus, in the example shown, spring 50 is positioned around beveled corners 70*a*, 70*b*, 70*c*, 70*d* of shaft portion 52 of first spindle 44, and is retained captive between head portion 54 of first spindle 44 and retainer device 48, e.g., a C-clip, that is attached to shaft portion 52 of first spindle 44. As shown in FIG. 5B, the corners of head portion 54 serve to restrain spring 50 on first spindle 44, while the flats 80*a*, 80*b*, 80*c*, and 80*d* of first spindle 44 serve to expose portions of spring 50 for engagement with shank 24 of door handle 14 when spindle assembly 20 is installed in door handle assembly 12.

Thus, referring also to FIG. 1, when spindle assembly 20 is connected to door handle 14, spring 50 engages a portion of shank 24 to bias spindle assembly 20 with respect to latch mechanism 18 in direction 60. More particularly, spring 50 engages shank 24 to position first hub drive portion 58 of first spindle 44 relative to first hub portion 38, and to position the second hub drive portion 74 of second spindle 46 relative to second hub portion 40. In the example shown in FIG. 1, for example, spring 50 forces retainer device 48 of the spindle assembly 20 in direction 60 until retainer device 48 engages latch mechanism 18.

Figure 6:
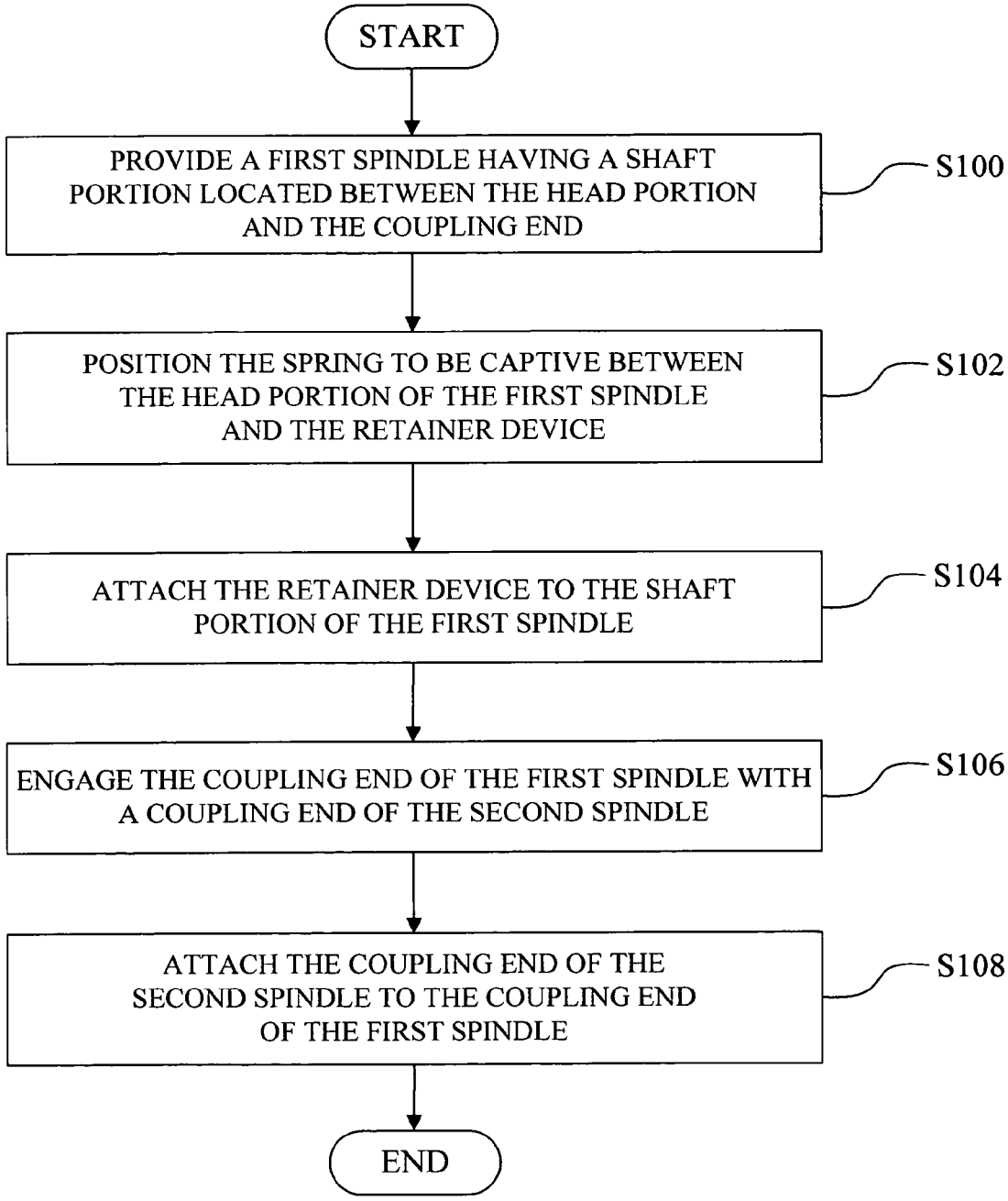
FIG. 6 is a flowchart of general steps for assembling the spindle assembly of FIGS. 2-4.

FIG. 6 is a general flowchart for making and assembling spindle assembly 20 for use, for example, with latch mechanism 18, as shown in FIG. 1.

At step S100, first spindle 44 is provided having shaft portion 52 located between head portion 54 and first coupling end 56. Shaft portion 52 and head portion 54 of first spindle 44 may be formed, for example, to have common orthogonal dimensions 62, 64 (see FIG. 5A) and to have at least one different diagonal dimension, e.g., diagonal dimension 66 of shaft portion 52 is smaller than diagonal dimension 68 of head portion 54. Peripheral groove 78 may be formed in shaft portion 52 at a location spaced from head portion 54 of first spindle 44 to receive retainer device 48, such as for example, a C-clip.

At step S102, spring 50 is positioned to be captive between head portion 54 of first spindle 44 and retainer device 48.

At step S104, retainer device 48 is attached to shaft portion 52 of the first spindle 44.

At step S106, coupling end 56 of first spindle 44 is slidably engaged with a coupling end 76 of second spindle 46.

At step S108, coupling end 76 of second spindle 46 is attached to coupling end 56 of first spindle 44, such as for example, by staking or crimping the end of coupling end 76 so that coupling end 56 is retained in coupling end 76. Thus, first spindle 44 and second spindle 46 are permanently joined, but remain independently rotatable with respect to each other about rotational axis 42. Once attached, the assembly of spindle assembly 20 is complete, and spring 50 can not be removed from spindle assembly 20 without destructive effort.

Figure 7:
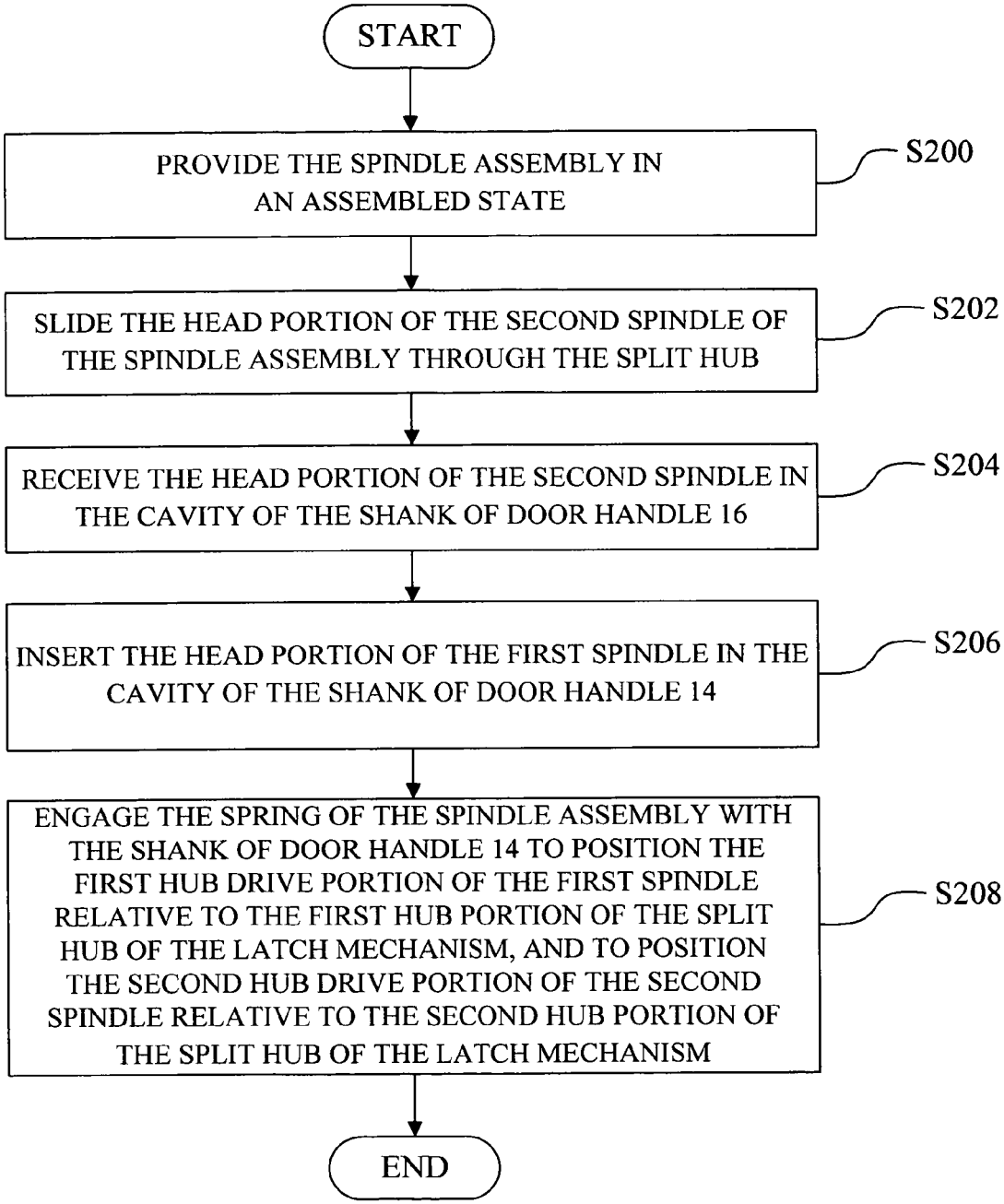
FIG. 7 is a flowchart of general steps for assembling the door handle assembly of FIG. 1.

FIG. 7 is a general flowchart of a method of assembling door handle assembly 12 of FIG. 1.

At step S200, spindle assembly 20 is provided in an assembled state, as discussed above.

At step S202, head portion 72 of the second spindle 46 of spindle assembly 20 is slid through split hub 36.

At step S204, after head portion 72 of the spindle assembly 20 passes through split hub 36, head portion 72 is received in cavity 32 of shank 30 of door handle 16. Door handle 16 may have been, for example, previously attached to door 10.

At step S206, head portion 54 of first spindle 44 is inserted in cavity 26 of shank 24 of door handle 14, such as for example, as door handle 14 is being mounted to door 10.

At step S208, spring 50 of the spindle assembly 20 engages shank 24 of door handle 14 to position first hub drive portion 58 of first spindle 44 relative to first hub portion 38 of split hub 36 of latch mechanism 18, and to position second hub drive portion 74 of second spindle 46 relative to second hub portion 40 of split hub 36 of latch mechanism 18. The engagement of spring 50 with shank 24 of door handle 14 may occur, for example, as door handle 14 is being mounted to door 10. The engagement of spring 50 with shank 24 of door handle 14 may be, for example, at an external end of shank 24, or may be at an interior ledge in cavity 26 in shank 24 of door handle 14.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A door handle assembly, comprising:

a latch mechanism having a split hub, said split hub having a first hub portion and a second hub portion, each of said first hub portion and said second hub portion being configured to independently operate said latch mechanism;

first and second door handles;

a spindle assembly including:

a first spindle operatively connected to said first door handle, having a shaft portion located between a first head portion and a first coupling end, said first head portion having a larger cross section than the shaft portion, said shaft portion having a first hub drive portion, said first hub drive portion being configured to engage said first hub portion when inserted into said split hub in a first direction;

a second spindle operatively connected to said second door handle, having a second head portion, a second hub drive portion and a second coupling end, said second coupling end being configured to slidably engage said first coupling end of said first spindle to provide independent rotational engagement of said first spindle with said second spindle, said second hub drive portion being configured to engage said second hub portion when inserted into said split hub in said first direction;

a retainer device attached to said shaft portion of said first spindle; and a spring positioned over said shaft portion of said first spindle between said first head portion of said first spindle and said retainer device attached to said shaft portion of said first spindle, said first head portion restraining said spring on said first spindle to be captive between said first head portion cross section and said retainer device.

2. The door handle assembly of claim 1, further comprising a door handle having an operator portion, and a shank extending from said operator portion, said shank having a cavity that slidably receives said first head portion of said first spindle, said spring engaging said shank to position said first hub drive portion of said first spindle relative to said first hub portion and to position said second hub drive portion of said second spindle relative to said second hub portion.

3. The door handle assembly of claim 1, further comprising a door handle having an operator portion, and a shank extending from said operator portion, said shank having a cavity that slidably receives said first head portion of said first spindle, said spring engaging said shank to bias said spindle assembly with respect to said latch mechanism in a first direction.

4. The door handle assembly of claim 3, wherein said spring forces said retainer device of said spindle assembly into engagement with said latch mechanism.

5. The door handle assembly of claim 1, wherein said shaft portion and said first head portion of said first spindle have common orthogonal dimensions and have at least one different diagonal dimension.

6. The door handle assembly of claim 2 wherein said shaft portion and said first head portion of said first spindle have common orthogonal dimensions and have at least one different diagonal dimension, wherein said common orthogonal dimensions define a generally rectangular structure in cross-section, and wherein said shaft portion has beveled corners at said diagonal dimension, thereby defining said first head portion of said first spindle.

7. The door handle assembly of claim 6, wherein said rectangular structure is a square structure.

8. The door handle assembly of claim 1, wherein said retainer device attached to said shaft portion of said first spindle has a peripheral groove, and said retainer device is a C-clip that engages said peripheral groove.

9. The door handle assembly of claim 1, wherein said first door handle has a first operator portion, and a first shank extending from said first operator portion, said first shank having a first cavity that receives said first head portion of said first spindle for common rotation with said first spindle about a rotational axis to operate said latch mechanism; and wherein said second door handle has a second operator portion, and a second shank extending from said second operator portion, said second shank having a second cavity that receives said second head portion of said second spindle for common rotation with said second spindle about said rotational axis to operate said latch mechanism independently from said first door handle.

10. A spindle assembly, comprising:

a first spindle having a shaft portion located between a first head portion and a first coupling end, said first head portion having a larger cross section than the shaft portion, said shaft portion having a first hub drive portion;

a second spindle having a second head portion, a second hub drive portion and a second coupling end, said second coupling end being configured to slidably engage said first coupling end to provide independent rotational engagement of said first spindle with said second spindle;

a retainer device attached to said shaft portion of said first spindle; and a spring positioned over said shaft portion of said first spindle between said first head portion of said first spindle and said retainer device attached to said shaft portion of said first spindle, said first head portion restraining said spring on said first spindle to be captive between said first head portion cross section and said retainer device.

11. The spindle assembly of claim 10, wherein said shaft portion and said first head portion of said first spindle have common orthogonal dimensions and have at least one different diagonal dimension.

12. The spindle assembly of claim 11, wherein said common orthogonal dimensions define a generally rectangular structure in cross-section, and wherein said shaft portion has reduced cross-section corners at said diagonal dimension, thereby defining said first head portion of said first spindle.

13. The spindle assembly of claim 12, wherein said reduced cross-section corners are one of beveled, rounded and a smaller square.

14. The spindle assembly of claim 12, wherein said rectangular structure is a square structure.

15. The spindle assembly of claim 10, wherein a retainer device attached to said shaft portion of said first spindle has a peripheral groove, and said retainer device is a C-clip that engages said peripheral groove.

16. The spindle assembly of claim 10, wherein said second coupling end of said second spindle is attached to said first coupling end of said first spindle.

17. A method of forming a spindle assembly for use with a latch mechanism, comprising:

providing a first spindle having a shaft portion located between a first head portion and a first coupling end, said first head portion having a larger cross section than the shaft portion, said shaft portion having a hub drive portion;

providing a second spindle having a second head portion, a second hub drive portion and a second coupling end, said second coupling end being configured to slidably engage said first coupling end to provide independent rotational engagement of said first spindle with said second spindle;

positioning a spring over said shaft portion of said first spindle between said first head portion of said first spindle and a retainer device attached to said shaft portion of said first spindle, said first head portion restraining said spring on said first spindle to be captive between said first head portion cross section and said retainer device;

slidably engaging said first coupling end of said first spindle with said second coupling end of said second spindle: and attaching said second coupling end of said second spindle to said first coupling end of said first spindle.

18. The method of claim 17, further comprising forming said shaft portion and said first head portion of said first spindle to have common orthogonal dimensions and to have at least one different diagonal dimension.

19. The method of claim 18, wherein said common orthogonal dimensions define a generally rectangular structure in cross-section, and wherein said shaft portion has reduced cross-section corners at said diagonal dimension, thereby defining said head portion of said first spindle.

20. The method of claim 19, wherein said rectangular structure is a square structure.

21. The method of claim 17, further comprising forming a peripheral groove in said shaft portion of said first spindle to receive said retainer device.

22. A method of assembling a door handle assembly, said door handle assembly including a latch mechanism having a split hub, said split hub having a first hub portion and a second hub portion, each of said first hub portion and said second hub portion being configured to independently operate said latch mechanism; a first door handle having a first operator portion, and a first shank extending from said first operator portion, said first shank having a first cavity; and a second door handle having a second operator portion, and a second shank extending from said second operator portion, said second shank having a second cavity, said method comprising:

providing a spindle assembly including a first spindle, a second spindle, a retainer device, and a spring positioned over a shaft portion of said first spindle between a first head portion of said first spindle and said retainer device attached to said shaft portion of said first spindle, said first head portion having a larger cross section than the shaft portion, said first head portion cross section restraining said spring on said first spindle to be captive between said first head portion cross section and said retainer device;

sliding a first coupling end of said first spindle within a second coupling end of said second spindle;

sliding a second head portion of said second spindle of said spindle assembly through the split hub;

inserting said first head portion of said first spindle in said first cavity of said first shank of said first door handle;

engaging said spring of said spindle assembly with said first shank of said first door handle to position a first hub drive portion of said first spindle relative to said first hub portion and to position a second hub drive portion of said second spindle relative to said second hub portion.

23. The method of claim 22, within after said second head portion of said spindle assembly passes through said split hub, said second head portion of said second spindle is received in said second cavity of said second door handle.

24. A door handle assembly, comprising:

a latch mechanism having a split hub, said split hub having a first hub portion and a second hub portion, each of said first hub portion and said second hub portion being configured to independently operate said latch mechanism;

first and second door handles;

a spindle assembly including:

a first spindle having a shaft portion located between a first head portion and a first coupling end, said first head portion having a larger cross section than the shaft portion, said shaft portion having a first hub drive portion, said first hub drive portion being configured to engage said first hub portion when inserted into said split hub in a first direction;

a second spindle having a second head portion, a second hub drive portion and a second coupling end, said second coupling end being configured to slidably engage said first coupling end of said first spindle to provide independent rotational engagement of said first spindle with said second spindle, said second hub drive portion being configured to engage said second hub portion when inserted into said split hub in said first direction;

a retainer device attached to said shaft portion of said first spindle; and a spring positioned captive between said first head portion cross section of said first spindle and said retainer device attached to said shaft portion of said first spindle, wherein said first coupling end of said first spindle fits within said second coupling end of said second spindle.

* * * * *